US005836232A

United States Patent [19]

Williams

[11] Patent Number: 5,836,232

[45] Date of Patent: Nov. 17, 1998

[54] CYLINDER SAFETY LOCK

[75] Inventor: Reid W. Williams, Mesa, Ariz.

[73] Assignee: Continental Eagle Corporation, Prattsville, Ala.

[21] Appl. No.: 747,288

[22] Filed: Nov. 12, 1996

[51] Int. Cl.[6] ..... F15B 15/26; E05F 3/12; E05C 17/00

[52] U.S. Cl. ..... 92/14; 16/82; 16/51; 92/28

[58] Field of Search ..... 16/82, DIG. 17, 16/DIG. 21, 51; 92/14, 28; 91/41

[56] References Cited

U.S. PATENT DOCUMENTS

| | | | |
|---|---|---|---|
| 1,594,330 | 7/1926 | Fisher | 92/28 |
| 3,350,137 | 10/1967 | Karlovsky, Jr. | 92/14 |
| 4,084,515 | 4/1978 | Kunz et al. | 92/14 |
| 4,813,100 | 3/1989 | King | 16/DIG. 17 |
| 5,048,150 | 9/1991 | Guerin | 16/82 |
| 5,207,490 | 5/1993 | Kaspar et al. | 16/DIG. 17 |
| 5,358,225 | 10/1994 | Volpel et al. | 16/84 |
| 5,659,925 | 8/1997 | Patterson | 16/82 |

*Primary Examiner*—Chuck Mah
*Assistant Examiner*—Donald M. Gurley
*Attorney, Agent, or Firm*—Thelen Reid & Priest

[57] ABSTRACT

A safety, fluid-actuated cylinder-and-piston mechanism for use with an article which is movable between first and second positions. The mechanism comprises a conventional, fluid-actuated cylinder-and-piston mechanism and an automatic locking bar. The piston rod of the cylinder-and-piston mechanism has one end attached to the movable article, and is movable between a fully retracted position in which the article is in its first position and a fully extended position in which the article is in its second position. The locking bar has a pivot end proximate the attachment between the piston rod and the movable article, and an opposite, nonpivot end. The locking bar is pivotable between a lowered and fully raised position and has a plurality of partially raised positions between its lowered and fully raised positions. It is positioned to rest on the cylinder when the piston rod is fully retracted into the cylinder and the article is in its first position, and is further dimensioned to drop off the cylinder into its lowered position and lock against the end of the cylinder when the piston rod is fully extended and the article is in its second position. Another cylinder-and piston mechanism is provided for automatically moving the locking bar from its lowered position to its fully raised position with its nonpivot end above the article-moving cylinder to enable the article to be moved from its second position to its first position.

10 Claims, 4 Drawing Sheets

CYLINDER SAFETY LOCK

BACKGROUND OF THE INVENTION

1. Field of the Invention

The present invention relates to cylinder-operated opening and closing devices. More specifically, the invention relates to a cylinder-operated safety lock for preventing accidental closure of such devices when in the opened position.

2. Related Art

Machine parts are frequently moved between an opened (or raised) position and a closed (or lowered) position by a cylinder-operated device. In such a device, the machine part is connected to a cylinder which is moved back and forth by a pneumatic or hydraulic fluid which is alternately introduced into and released from a cylinder. Similarly, piston-and-cylinder springs may be used to hold open doors and lids on furniture, appliances, and similar items. If the cylinder loses fluid pressure, the machine part, door, lid, or other article can close suddenly, causing injury to a person working in the vicinity. The prior art has thus proposed a variety of manual latches to prevent accidental closure.

Once example of such a latch, for use in connection with a cabinet lift-top, is described in U.S. Pat. No. 5,207,490 to Kaspar et al. Gas springs 20 are connected between a cabinet 10 and a lift-top lid 11, with the gas springs releasably holding the lid in an upward, open position. When the piston reaches its fully-extended position, gravity automatically pivots a safety latch 30 into a latched position over the piston, in which it bears against the cylinder and prevents retraction of the cylinder back into the piston. To release the latch, pressure is manually applied to a finger on the latch, in order to pivot the latch out of engagement with the piston and cylinder.

U.S. Pat. No. 4,813,100 to King discloses a tubular brace which can be manually inserted over the piston of a piston-and-cylinder mechanism to keep the piston-and-cylinder mechanism in the extended or open position, to support a door, window, lid, or the like.

A somewhat more sophisticated mechanism is disclosed in U.S. Pat. No. 5,358,225 to Volpel et al. for supporting the weight of a garbage truck tailgate. A telescopic spring unit includes a cylinder 26 and a piston rod 30 extendable from the front end 26*a* of the cylinder to open the tailgate of the garbage truck. A locking sleeve 22 is pivotally attached to one end of the piston rod by a tilting ball joint 32. An eccentric force is generated on the locking sleeve 22 by the weight of the tailgate member being lifted by the extension of the piston rod from the cylinder. The eccentric force causes a tilting clockwise movement of the locking sleeve as a result of the offset between the axis along which the compressive force is applied and the point of contract between the locking sleeve and the tilting ball joint. When the piston rod is fully extended, the locking sleeve is rotated so that its lower end rests against the front end of the cylinder, thus preventing the piston from retracting. For the tailgate to be closed, the locking sleeve must be manually repositioned.

Although the King and Kaspar latches move into position automatically upon opening of the article to which their pistons are attached, they still must be manually disengaged, at a minimum putting the operator's fingers into contact with the opening-and-closing mechanism, and thus at risk of injury.

An industrial application of a manually-released safety catch can be found in the LE-176 Saw Linter made by IMPCO, Industrial Metal Products Division of Continental Eagle Corporation. The LE-176 Linter uses (176) 18 inch diameter saws to de-lint cottonseed. The saws must be removed from the linter for resharpening as often as once a day. With reference to FIG. 1, in which reference numeral 2 generally denotes the saw linter, the saws are located on a saw mandrel 4 which is located under a movable linter breast 6. An hydraulic cylinder-and-piston mechanism 10 is used to raise (open) and lower (close) the linter breast 6, to facilitate removal and installation of the saw mandrel 4. An identical cylinder-and-piston mechanism 10 is located on the opposite side of the linter breast 6. Mandrel cylinder-and-piston mechanisms 8 are provided for lifting the saw mandrel 4 out of the saw linter 2 once the linter breast 6 is open, and for returning the sharpened saw mandrel 4 to the linter 2.

When the linter breast 6 is opened, an operator manually places a safety channel 12 on the piston rod of the cylinder-and-piston mechanism 10 to provide a positive lock against the breast 6 falling uncontrollably if the hydraulic system fails; and when the linter breast 6 is ready to be closed, the operator manually removes the safety channel 12. Because, as with the King device, placement and removal of the safety channel 12 must be performed manually by an operator, there is no guarantee that the safety channel 12 will be used at all; or if used, that the operator will install it correctly. Further, the manual removal again puts the operator at risk for injury.

Thus, it will be appreciated that there is a need for a safety lock for piston-and-cylinder mechanisms of which both the placement and removal can be achieved automatically. It is the solution of this and other problems to which the present invention is directed.

SUMMARY OF THE INVENTION

It is therefore a primary object of the present invention to provide a safety lock for piston-and-cylinder mechanisms which will automatically move into a locking position upon full extension of the piston rod.

It is another primary object of the present invention to provide a safety lock for piston-and-cylinder mechanisms which can be removed to enable retraction of the piston rod into the cylinder without manual intervention by an operator.

These and other objects are achieved by provision of a safety, fluid-actuated cylinder-and-piston mechanism for use with an article, such as the linter breast of a saw linter, which is movable between first and second positions. The mechanism comprises a conventional, fluid-actuated cylinder-and-piston mechanism and an automatic locking bar. The cylinder-and-piston mechanism includes an article-moving cylinder, an article-moving piston movable in the article-moving cylinder, and an article-moving piston rod having a first end attached to the article-moving piston and a second end attached to the movable article. The article-moving piston rod is movable between a fully retracted position in which the article is in its first position and a fully extended position in which the article is in its second position.

The locking bar has pivot and nonpivot ends. The pivot end is proximate the attachment between the article-moving piston rod and the movable article, with the nonpivot end being opposite the pivot end. The locking bar is pivotable between a lowered and fully raised position and has a plurality of partially raised positions between its lowered and fully raised positions. It is positioned to rest on the article-moving cylinder when the article-moving piston rod is fully retracted into the article-moving cylinder and the article is in its first position, and is further dimensioned to drop off the article-moving cylinder into its lowered position and lock against the end of the article-moving cylinder when the article-moving piston rod is fully extended and the article is in its second position.

Means are provided for automatically moving the locking bar from its lowered position to its fully raised position with its nonpivot end above the article-moving cylinder to enable the article to be moved from its second position to its first position. In one aspect of the invention, the automatic moving means is another fluid-actuated cylinder-and-piston mechanism. This mechanism includes a locking bar cylinder positioned proximate the pivot end of the locking bar, a locking bar piston movable in the locking bar cylinder, and a locking bar piston rod having a first end attached to the locking bar piston and a second end positioned to engage the locking bar proximate the pivot end and to pivot the locking bar into its raised position above the article-moving cylinder. In a further aspect of the invention, the locking bar has a laterally-extending shoulder proximate its pivot end and in alignment with the locking bar piston rod. When the operator initiates closure of article, a hydraulic sequence valve first directs fluid to the locking bar cylinder, causing the locking bar piston rod to extend and engage the locking bar shoulder, pivoting the locking bar into its fully raised position above the end of the article-moving cylinder. When fluid pressure in the locking bar cylinder rises to a predetermined level, the sequence valve allows the article-moving cylinder to retract.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE PREFERRED EMBODIMENTS

Figure 1:
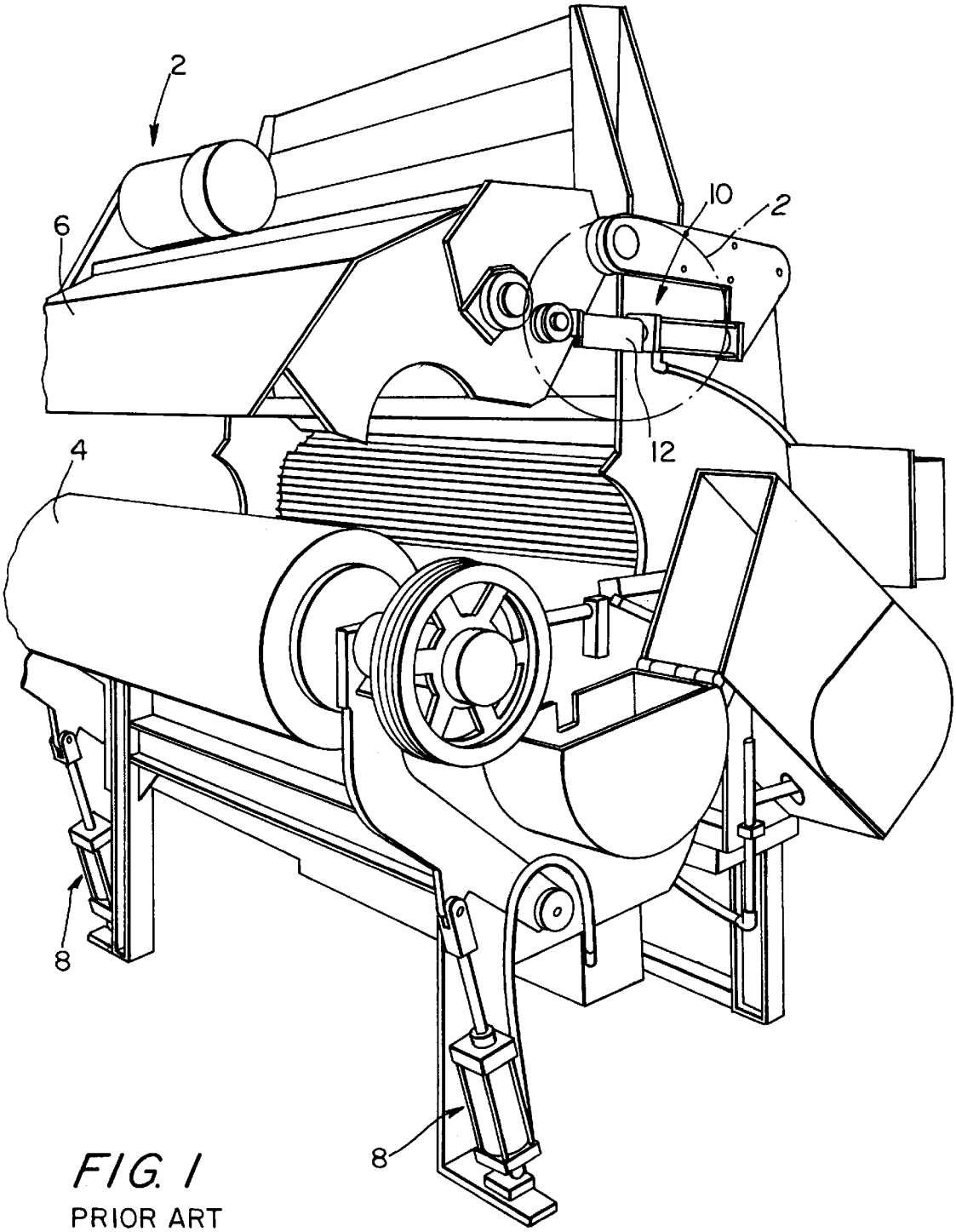
FIG. 1 PRIOR ART
FIG. 1 is a partial perspective view of a conventional saw linter using a conventional channel lock.

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose.

Figure 2:
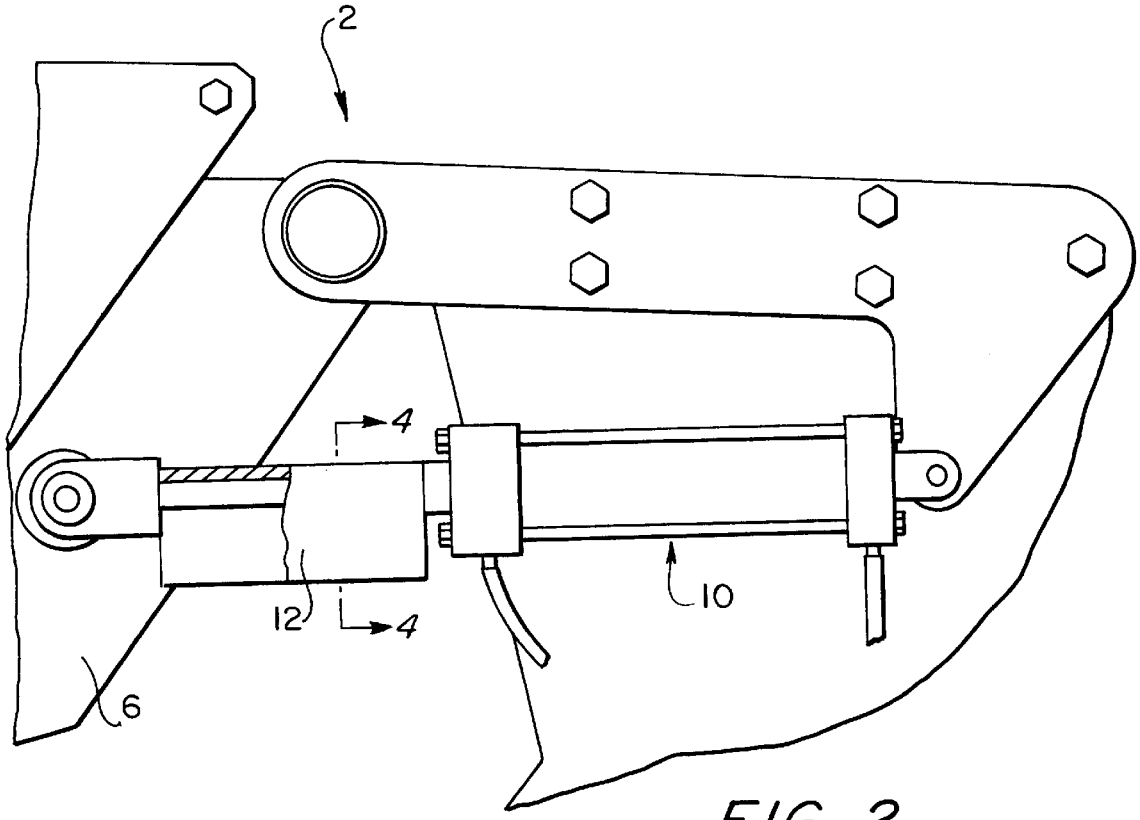
FIG. 2 PRIOR ART
FIG. 2 is an enlarged side elevational view, with parts broken away, of the area enclosed by the dashed circle in FIG. 1.
Figure 3:
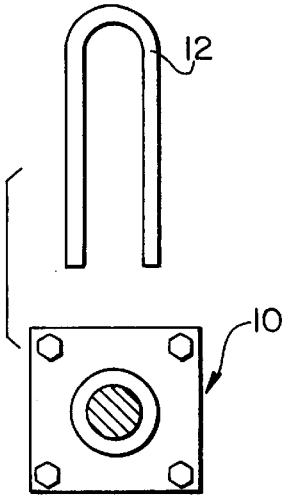
FIG. 3 PRIOR ART
FIG. 3 is a cross-sectional view of the channel lock being removed from the cylinder rod of FIG. 1.
Figure 4:
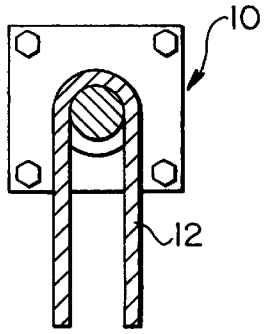
FIG. 4 PRIOR ART
FIG. 4 is a cross-sectional view taken along line 4—4 of FIG. 2.

Referring now to FIG. 2, there is shown a cylinder lock mechanism 100 in accordance with the present invention in use in an otherwise conventional saw linter 102 similar to that described with reference to FIG. 1. However, as will be appreciated by those of skill in the art, the cylinder lock mechanism 100 can be applied to any cylinder-and-piston mechanism in which it is desired to lock the piston rod against retraction into the cylinder, for example to prevent accidental closure of a door or lid being held open by the extended piston rod. Also, as will be appreciated by those of skill in the art, like any other safety mechanism, the cylinder safety lock in accordance with the present invention is not asserted to be tamper-proof, and probably is capable of being circumvented.

As is conventional, the saw linter 102 includes a saw mandrel (not shown) and a linter breast 6 covering the saw mandrel, just as are used in the saw linter 2 described with respect to FIG. 1. Linter breast 6 is movable from a closed (lowered) position to an open (raised) position to enable removal of a dull saw mandrel and installation of a sharpened saw mandrel. Also as with the saw linter 2 described with respect to FIG. 1, mandrel cylinder-and-piston mechanisms 8 are provided for lifting the saw mandrel out of the saw linter 2 once the linter breast 6 is open, and for returning the sharpened saw mandrel to the linter 2.

The linter breast 6 is moved between its closed and open positions by a fluid-actuated cylinder-and-piston mechanism 110. Although the cylinder-and-piston mechanism 110 can be either hydraulic or pneumatic (or even steam-powered), in the context of a saw linter 102, an hydraulic system is preferred; the system thus will be referred to henceforth as an hydraulic system, although it will be appreciated by those of skill in the art that the invention is equally applicable to a pneumatic system, and that "pneumatic" or "steam" could be substituted for "hydraulic" hereafter.

The cylinder-and-piston mechanism 110 includes a breast cylinder 120 having a shoulder 122 at its open end, a breast piston 130 (shown in FIG. 5) slidable within cylinder 120, and a breast piston rod 132 (also shown in FIG. 5) connected at one end to the piston 130 and movable between a fully retracted and a fully extended position corresponding to the closed and open positions of the linter breast 6. Two breast hoses, a rod end port hose 134*a* and a blind end port hose 134*b*, connect the breast cylinder 120 with a source of hydraulic fluid (not shown) via a conventional pilot-operated double check valve 136. The piston rod 132 is attached at its other end to the linter breast 6 by a rod eye 140.

A locking bar 142 is pivotably connected to the rod eye 140 by a pivot pin 144, and is pivotable about pivot pin 144 between a fully raised position and a lowered position, and a plurality of partially raised positions between the lowered and fully raised positions. The locking bar 142 has a laterally-projecting shoulder 142*a* at its end adjacent the pivot pin 144, for a purpose to be described hereinafter.

Figure 8:
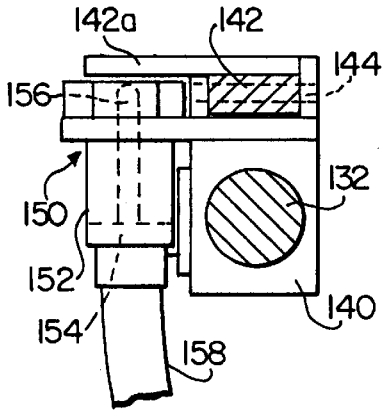
FIG. 8 is a cross-sectional view taken along line 8—8 of FIG. 6.
Figure 9:
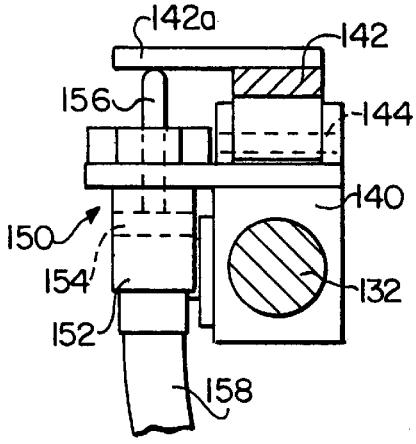
FIG. 9 is a cross-sectional view taken along line 9—9 of FIG. 7.

A locking bar cylinder-and-piston mechanism 150 is provided to lift the locking bar 142 at its pivot end. As best shown in FIGS. 8 and 9, the locking bar cylinder-and-piston mechanism 150 includes a locking bar cylinder 152, a locking bar piston 154 slidable within the cylinder 152, and a locking bar piston rod 156 attached to the piston 154 and positioned under the locking bar shoulder 142*a* for engagement with the locking bar shoulder 142*a* when in its extended position. A locking bar hose 160 connects the locking bar cylinder 152 to the source of hydraulic fluid. The locking bar hose 160 also is connected to the double check valve 136 and the rod end port hose 134*a* through a conventional hydraulic sequence valve 162.

Although there are two cylinder-and-piston mechanisms 110 and 150, one on each side of the saw linter 102, there is only one double check valve 136 and one hydraulic sequence valve 162, the hoses of both cylinder-and-piston mechanisms 110 and both cylinder-and-piston mechanisms 150 being routed with respect to valves 136 and 150 as described in the preceding paragraph.

The locking bar 142 is positioned to rest on the top of the breast cylinder 120 when the breast piston rod 132 is fully retracted into the breast cylinder 120 and the linter breast 6 is in its closed position; and is dimensioned to drop off the breast cylinder 120 into its lowered position and lock against the end of the breast cylinder 120 when the breast piston rod 132 is fully extended to move the linter breast 6 article into open position.

Figure 5:
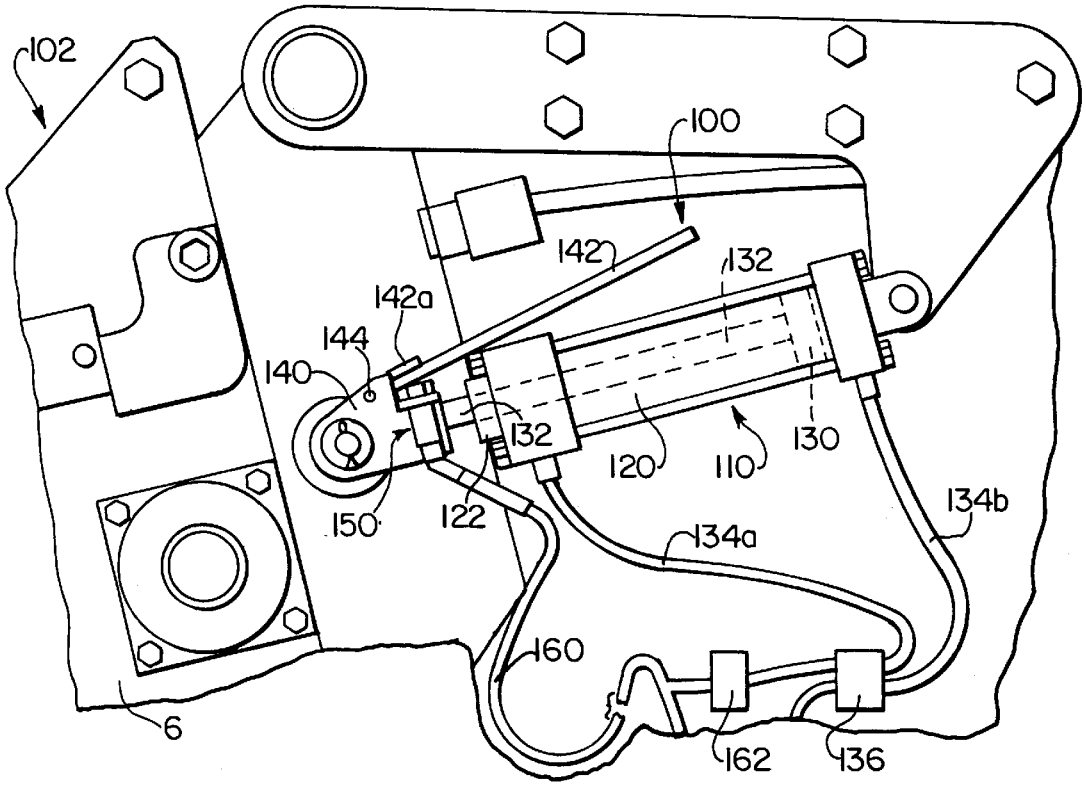
FIG. 5 is a partial side elevational view of a saw linter incorporating a cylinder safety lock in accordance with the present invention, with the linter breast of the saw linter being in the closed position and the cylinder safety lock being disengaged.
Figure 6:
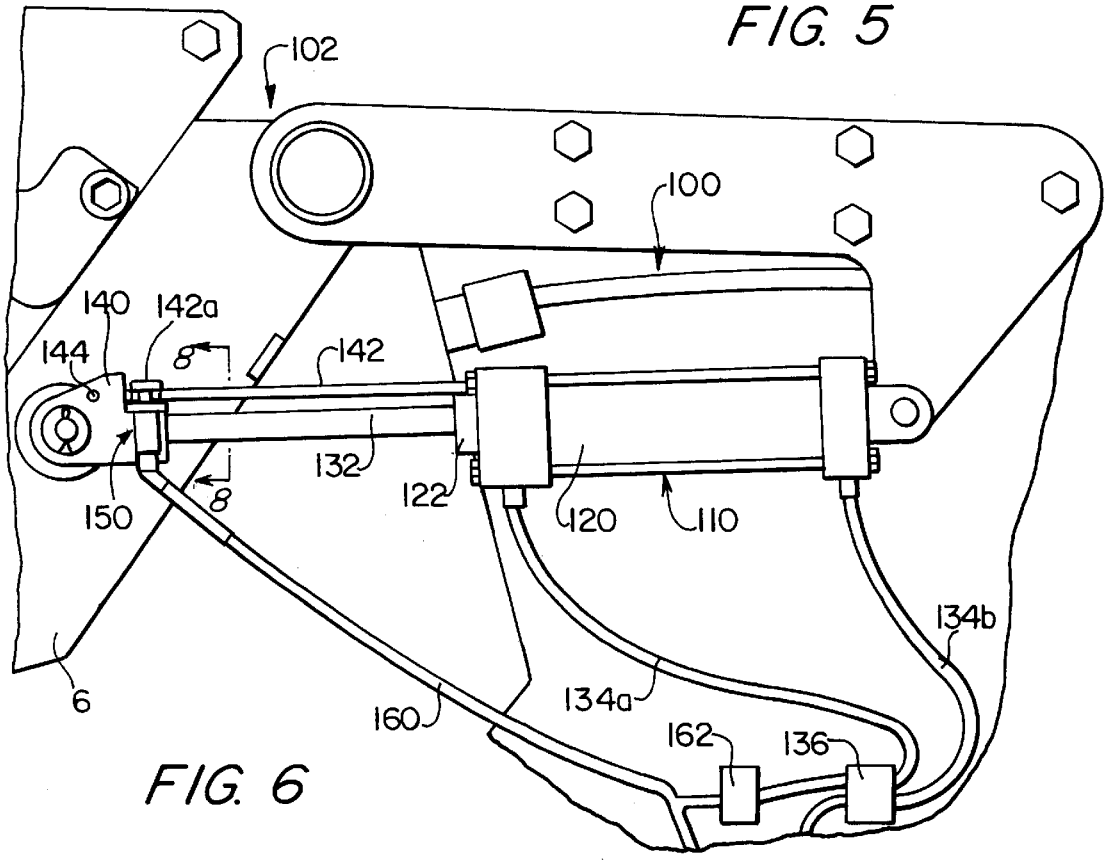
FIG. 6 is a partial side elevational view of the saw linter of FIG. 5, with the linter breast in the open position and the cylinder safety lock being engaged.

Referring now to FIGS. 5–9, FIG. 5 shows the linter breast 2 in the closed position with the locking bar 142 in a partially-raised position resting on top of the breast cylinder 120. When the operator activates the cylinder-and-piston mechanism 110 to open the linter breast 2, the locking bar 142 slides along the top of the breast cylinder 120 as the breast piston rod 132 extends out from the breast cylinder 120, as shown in FIG. 5. When the breast cylinder 120 is fully extended, as shown in FIG. 6, the locking bar 142 drops (due to gravity) to its lowered position with its non-pivoted end resting on the shoulder 122 of the breast cylinder 120. Were a sudden loss of hydraulic to occur pressure (caused, for example, by breakage of one of hoses 134*a* and 134*b*), the locking bar 142 would lock against the end of the breast cylinder 120, preventing the linter breast 2 from falling closed.

Figure 7:
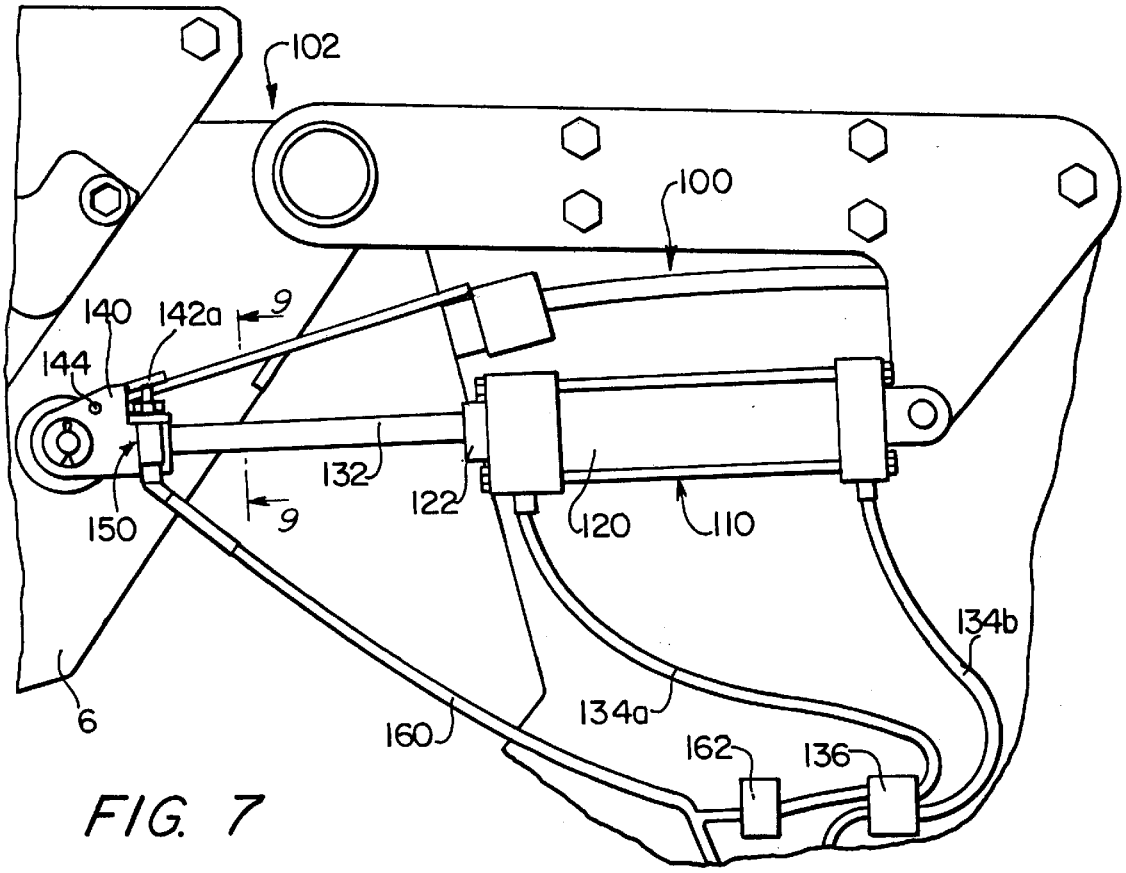
FIG. 7 is a partial side elevational view of the saw linter of FIG. 5, with the linter breast in the open position and the cylinder safety lock being fully raised to permit the linter breast to return to the closed position.

When the operator initiates closure of the linter breast 2, the hydraulic sequence valve 136 first directs fluid to the locking bar cylinder 152, causing the locking bar piston rod 156 to extend and engage the locking bar shoulder 142*a*, pivoting the locking bar 142 into its fully raised position above the end of the breast cylinder 120, as shown in FIGS. 7 and 9. When fluid pressure in the locking bar cylinder 152 rises to a pre-determined level, the sequence valve 162 directs hydraulic fluid to the double check valve 136, which in turn directs hydraulic fluid to the rod end port hose 134*a* and the rod end of the breast cylinder 120, allowing the breast cylinder piston rod 132 to retract, closing the linter breast 2 and returning all parts of the saw linter 2 to the positions shown in FIG. 5.

Figure 10:
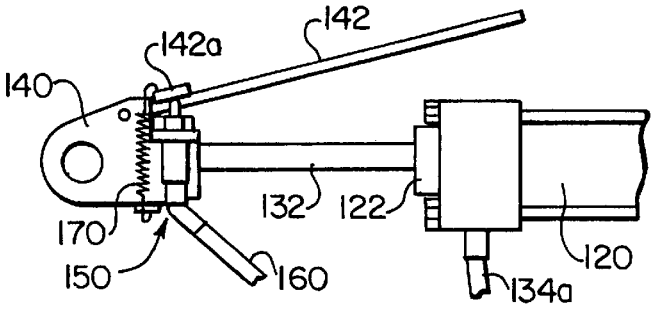
FIG. 10 is a close up side elevational view of the breast cylinder shown in FIG. 7 including a spring to bias the lock bar to a lowered position.

Modifications and variations of the above-described embodiments of the present invention are possible, as appreciated by those skilled in the art in light of the above teachings. For example, as discussed above, the cylinder lock mechanism 100 need not be restricted to use in a saw linter, but can be applied to any cylinder-and-piston mechanism in which it is desired to lock the piston rod against retraction into the cylinder. Further, the locking bar 142 can be caused to pivot into a locked position by a spring 170 attached between the shoulder 142*a* and a point on eye rod 140, as shown in FIG. 10. The addition of the spring 170 normally biases the locking bar 142 into its lowered position, and permits the cylinder safety lock in accordance with the invention to be used in applications where gravity cannot be relied on to cause the locking bar 142 to drop into a locked position.

It is therefore to be understood that, within the scope of the appended claims and their equivalents, the invention may be practiced otherwise than as specifically described.

What is claimed is:

1. An arrangement for a safety lock for a cylinder-and-piston mechanism that is used to move an article between first and second positions, the cylinder-and-piston mechanism including an article-moving cylinder, an article-moving piston movable in the article-moving cylinder, and an article-moving piston rod having a first end attached to the article-moving piston and a second end attached to the movable article and being movable between fully retracted and fully extended positions corresponding to the first and second positions of the article, the arrangement comprising:

a) a locking bar having a pivot end proximate the attachment between the article-moving piston rod and the movable article and a non-pivot end opposite the pivot end, said locking bar being pivotable between a lowered and fully raised position and having a plurality of partially raised positions between its lowered and fully raised positions, said locking bar being positioned to rest on the article-moving cylinder when the article-moving piston rod is fully retracted into the article-moving cylinder and the article is in its first position and being dimensioned to drop off the article-moving cylinder into its lowered position and lock against the end of the article-moving cylinder when the article-moving piston rod is fully extended and the article is in its second position; and b) means for automatically moving said locking bar from its lowered position to its fully raised position with its non-pivot end above the article-moving cylinder to enable the article to be moved from its second position to its first position, wherein said moving means includes:

1) a locking bar cylinder positioned proximate said pivot end of said locking bar;

2) a locking bar piston movable in said locking bar cylinder; and 3) a locking bar piston rod having a first end attached to said locking bar piston and a second end positioned to engage said locking bar proximate said pivot end and to pivot the locking bar into its raised position above the article-moving cylinder.

2. The arrangement of claim 1, wherein said locking bar has a laterally-extending shoulder proximate its pivot end and in alignment with said locking bar piston rod.

3. The arrangement of claim 1, wherein said moving means further includes a mechanically-implemented biasing means for normally biasing said locking bar in said lowered position.

4. The arrangement of claim 2, wherein said moving means further comprises a mechanically-implemented biasing means for normally biasing said locking bar in said lowered position.

5. The arrangement of claim 4, wherein said biasing means comprises a spring having a first end attached to said shoulder and a second end attached to the movable article proximate said second end of said article-moving piston rod.

6. An arrangement for a safety cylinder-and-piston mechanism used with an article that is movable between first and second positions, said arrangement comprising:

a) an article-moving cylinder;

b) an article-moving piston movable in said article-moving cylinder;

c) an article-moving piston rod having a first end attached to said article-moving piston and a second end attached to the movable article, said article-moving piston rod being movable between a fully retracted position in which the article is in its first position and a fully extended position in which the article is in its second position;

d) a locking bar having a pivot end proximate the attachment between said article-moving piston rod and the movable article and a non-pivot end opposite said pivot end, said locking bar being pivotable between a lowered and fully raised position and having a plurality of partially raised positions between its lowered and fully raised positions, said locking bar being positioned to rest on said article-moving cylinder when said article-moving piston rod is fully retracted into said article-moving cylinder and the article is in its first position and being dimensioned to drop off said article-moving cylinder into its lowered position and lock against the end of said article-moving cylinder when said article-moving piston rod is fully extended and the article is in its second position; and e) means for automatically moving said locking bar from its lowered position to its fully raised position with its non-pivot end above said article-moving cylinder to enable the article to be moved from its second position to its first position, wherein said moving means includes:

1) a locking bar cylinder positioned proximate said pivot end of said locking bar;

2) a locking bar piston movable in said locking bar cylinder; and 3) a locking bar piston rod having a first end attached to said locking bar piston and a second end positioned to engage said locking bar proximate said pivot end and to pivot the locking bar into its raised position above the article-moving cylinder.

7. The arrangement of claim 6, wherein said locking bar has a laterally-extending shoulder proximate its pivot end and in alignment with said locking bar piston rod.

8. The arrangement of claim 6, wherein said moving means further includes a mechanically-implemented biasing means for normally biasing said locking bar in said lowered position.

9. The arrangement of claim 7, wherein said moving means further comprises a mechanically-implemented biasing means for normally biasing said locking bar in said lowered position.

10. The arrangement of claim 9, wherein said biasing means comprises a spring having a first end attached to said shoulder and a second end attached to the movable article proximate said second end of said article-moving piston rod.

* * * * *